United States Patent [19]

George et al.

[11] 4,438,696

[45] Mar. 27, 1984

[54] MULTI-PURPOSE FLEXOGRAPHIC PRESS MODULE

[75] Inventors: John W. George, Meriden; Eugene D. Rudolph, Topeka, both of Kans.

[73] Assignee: Express Card & Label Co., Topeka, Kans.

[21] Appl. No.: 358,116

[22] Filed: Mar. 15, 1982

[51] Int. Cl.[3] ..... B41F 5/06; B41F 5/18

[52] U.S. Cl. ..... 101/180; 101/228

[58] Field of Search ..... 101/178, 179, 180, 181, 101/182, 176, 136, 137, 138, 139, 140, 143, 219, 220, 222, 225, 228, 350, 351, 352, 349, 221

[56] References Cited

U.S. PATENT DOCUMENTS

| | | | |
|---|---|---|---|
| 2,565,570 | 8/1951 | Messinger | 101/416 A |
| 2,579,264 | 12/1951 | Lamatsch | 101/221 X |
| 2,625,878 | 1/1953 | Baumgartner | 101/247 |
| 2,690,121 | 9/1954 | Auerbacher | 101/247 X |
| 2,836,115 | 5/1958 | Page | 101/219 |
| 3,190,218 | 6/1965 | Willard | 101/247 |
| 3,218,969 | 11/1965 | Nagel | 101/181 |
| 3,274,930 | 9/1966 | Nagel | 101/221 X |
| 3,331,318 | 7/1967 | Augustyn et al. | 101/152 |
| 3,611,926 | 10/1971 | Johnson | 101/178 |
| 3,889,596 | 6/1975 | Thomas et al. | 101/247 |
| 4,138,944 | 2/1979 | Biggar | 101/247 |

FOREIGN PATENT DOCUMENTS

| | | | |
|---|---|---|---|
| 1459424 | 11/1966 | France | 101/181 |

OTHER PUBLICATIONS

*Package Printing & Diecutting*, Nov. 1975, pp. 39–41.

*Primary Examiner*—J. Reed Fisher

*Attorney, Agent, or Firm*—Schmidt, Johnson, Hovey & Williams

[57] ABSTRACT

The module is adapted to be attached to and suspended from a flexographic printing press in order to provide an additional web printing station and other options such as an ultraviolet curing device and a die cutting station. Guide rollers for the web being printed are so positioned that the web may be entrained around them in a manner to present the web to the print station of the module for backside printing thereof after the front side of the web has been printed by the primary press. The module derives its driving power for the various rollers and other components thereof from the primary press, and a quick change feature within the drive coupling between the press and the module enables the rollers of the module print station to be driven in a reverse mode for such backside printing, notwithstanding the fact that the print stations of the main press remain driven in the forward mode, as well as the web.

9 Claims, 10 Drawing Figures

MULTI-PURPOSE FLEXOGRAPHIC PRESS MODULE

TECHNICAL FIELD

This invention relates to the field of flexographic printing, and, more particularly, to a module-like attachment which may be added onto an existing flexographic printing press for the purpose of enabling the resulting press assembly to perform additional functions and operations on the web being processed that would not be possible on the main press alone.

BACKGROUND ART

Flexographic printing involves, among other things, the use of rapid drying, liquid inks which are applied to webs of paper stock by a plate roll having a raised surface bearing against an impression roll which backs up the web. As a result of the fast-drying characteristics of the liquid inks used in this art, a "central impression" type of flexographic press can be provided which utilizes a relatively large diameter impression roll about which is positioned a series of print stations, each including its own plate roll for applying an image to the web as it is advanced around the common impression roll for all of the stations. In this manner several different colors can be printed in rapid succession whereupon other operations such as die cutting and/or coating and curing the printed material with a protective finish may be performed, all without the risk of smearing the inks or otherwise damaging the finished product. "In-line" presses having an impression roll for each print station are also available.

It is not uncommon for presently available flexographic presses to be provided with three print stations so as to permit three-color printing. However, in order to obtain four-color capability, it is typically necessary to acquire a much larger press, whether "central impression" or "in-line", that is considerably more expensive and complex mechanically, therefore placing four-color capability out of the reach of many small operators unable to afford the capital costs involved in such larger machines. Moreover, even in the more expensive central impression machines, it has not heretofore been possible to achieve backside printing of the web, and in the in-line machines, that special feature is only available if a costly turnbar assembly is employed between a pair of the print stations to flip over the web as it passes from one station to the next. Turnbars, while adequately serving the purpose of presenting the opposite side for printing, also introduce a number of undesirable factors which make their use not particularly attractive.

SUMMARY OF THE PRESENT INVENTION

Accordingly, one important object of the present invention is to provide dramatically increased performance capabilities and flexibility in the selection of performance options in a flexographic press without the capital investment normally required to obtain such features in presently available flexographic presses.

Pursuant to the foregoing, the present invention contemplates a special, add-on module for existing flexographic presses which derives its operating power from mechanism already available on the press, yet which may be relatively, quickly and easily installed and removed from the main press. An additional print station on the module includes its own impression cylinder separate and apart from the large impression cylinder or roll commonly shared by the print stations of the main press so that an additional color may be printed beyond that available with the main press alone. Furthermore, the driving arrangement for the module print station may be easily changed to a reverse mode such that the rolls of the module print station are likewise reversely driven, thereby permitting the web to be threaded through the module and the print station in such a manner that backside printing of the web may be performed at that location. Provisions are also made for the module to readily receive an ultraviolet curing device in the event that a special, protective finish is applied to the web, either in the main press or at the module print station, and other operations such as die cutting and stripping of the die cut material may likewise be provided on the module. A special adjustment for the plate roll of the module print station enables the same to readily compensate for the varying thicknesses of webs which may be run through the machine as different production runs are made by the operator.

DETAILED DESCRIPTION

Figure 1:
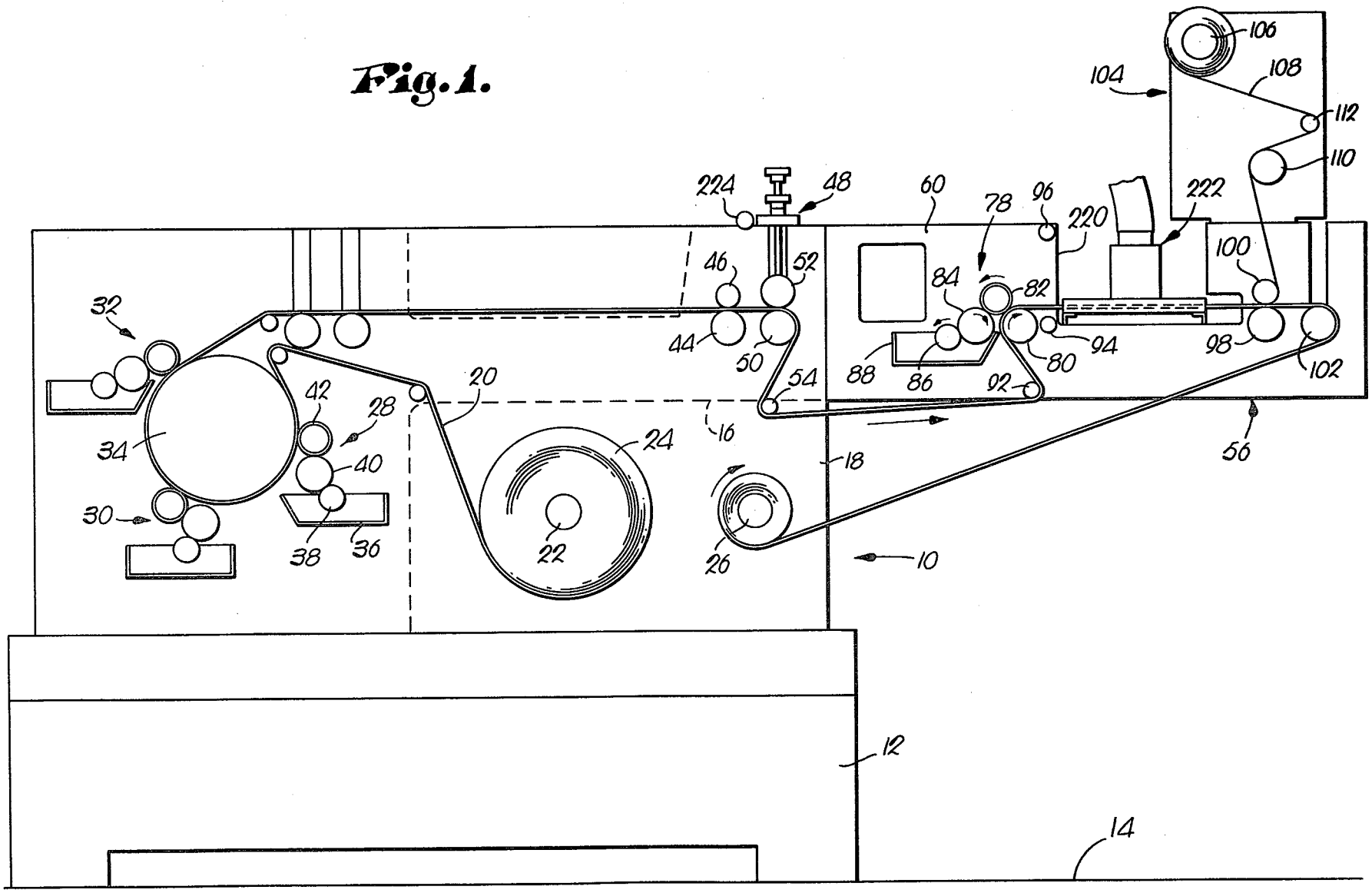
FIG. 1 is a schematic, side elevational view of a flexographic press in combination with an add-on attachment module constructed in accordance with the principles of the present invention, the module being arranged for front side printing of the web which passes through the main press and the module and the near side plate being removed.

The main press 10 as schematically illustrated broadly includes a base 12 resting on the floor 14, a pair of upstanding support plates 16 and 18 (see FIGS. 3 and 5 for the plate 16, for example), and a multiplicity of rolls and other operating components supported by the plates 16, 18 for operating upon a web 20 of paper stock as it is advanced through the press 10. Included within such mechanisms and components is a dispensing spindle 22 which carries a coil 24 of the web 20 to be dispensed, and a take-up spindle 26 driven in a clockwise direction viewing FIG. 1 to pull the web 20 from the dispensing spindle 22.

Further included in the mechanisms which operate on the web 20 is a series of print stations 28, 30 and 32 which are clustered about a common, relatively large diameter impression cylinder or roll 34. The web 20 is entrained about the impression roll 34 in the manner shown so as to be progressively presented to the stations 28, 30 and 32 for the application of a printed image thereto. Each of the stations 28, 30 and 32 includes an ink tray 36 holding a supply of a liquid ink of suitable color, quality and viscosity, a metering roll 38 which is partially immersed within the ink of tray 36, an anilox roll 40 above the metering roll 38 and in peripheral engagement therewith for receiving ink therefrom, and a plate roll 42 which peripherally engages the anilox roll 40 and simultaneously peripherally engages the web 20 as it passes between the latter and the impression roll 34. Each plate roll 42 is provided with a suitable, raised, web engaging surface of resilient material which becomes inked by the anilox roll 40 and which transfers an image to the web 20. Various other rolls are provided in the press 10 for maintaining proper tension on the web 20 as it advances through the machine, these including, for example, the cooperating nip rolls 44 and 46 adjacent the upper end extremity of the machine where the web 20 exits. Various optional devices may be typically added to the machine 10, such as, for example, a die cutting station 48, including cooperating rolls 50 and 52, which are useful in those situations where the web 20 comprises two layers of material, one of which is to form a label that will be die cut and ultimately stripped from the underlying supporting layer of the web. Typically, after the web 20 passes through the die cut station 48, it travels directly to the take-up spindle 26 after engaging the guide roll 54.

In accordance with the present invention an add-on module 56 may be detachably suspended from the main press 10 to increase the performance capabilities thereof. The module 56 includes a pair of upright frame plates 58 and 60 which are maintained in laterally, spaced apart relationship at the same distance as the spacing between the plates 16 and 18 of the main press 10. The plates 58 and 60 are provided with flat end edges **58*a* and 60*a* which abuttingly engage opposing flat end edges 16*a* and 18*a* of the main press plates 16 and 18. End edges 16*a*, 18*a* and 58*a*, 60*a* are prepared in such a manner that they are square with their respective plates 16, 18 and 58, 60 to the end that rolls of the main press 10 will be in parallel relationship with hereinafter described rolls associated with the module 56**, all of which is critical to smooth, trouble-free operation.

The frame plates 58 and 60 are also provided with a pair of guide plates 62 and 64, respectively (FIGS. 3, 4 and 5, for example), each of which is suitably affixed to the inner face of its corresponding frame plate 58 or 60 and projects outwardly beyond the edge **58*a* or 60*a* so as to overlap the corresponding support plate 16 or 18 of the main press 10 when the module 56 is attached. The two guide plates 62 and 64 thus help align the module 56 with respect to the main press 10 and its support plates 16, 18 during installation as the guide plates 62 and 64 become slipped between the support plates 16 and 18. A cross pin 66 having a knob 68 at one end thereof may be passed through a plurality of apertures 70, 72, 74 and 76 (FIG. 5) in the plates 16, 62, 64 and 18, respectively, when such apertures are brought into alignment, such alignment occurring when the end edges 16*a*, 18*a* and 58*a*, 60*a* are abuttingly engaged as above described, and the module 56 is vertically positioned at the proper location. cross pin 66 thus serves to releasably retain the module 56 on the main press 10 in a stable manner, cooperatively assisted by the interabutting edges 16*a*, 58*a*, and 18*a*, 60*a***. If desired, additional cross pins or the like may be utilized as a part of this quick attach and detach arrangement, although such additional equipment is not necessary.

Figure 4:
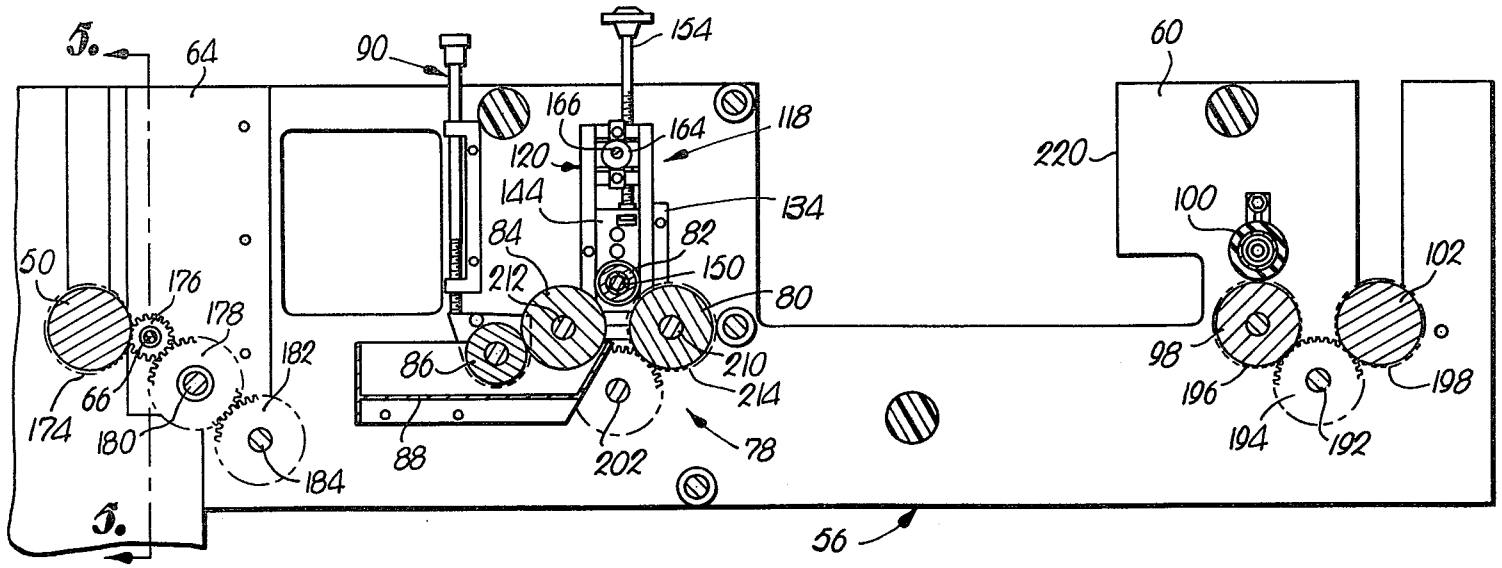
FIG. 4 is a longitudinal, vertical cross-sectional view through the fragmentarily shown apparatus of FIG. 3 and taken substantially along line 4—4 thereof.

The module 56 is also provided with a print station 78 that includes a relatively small diameter impression roll 80, a plate roll 82, an anilox roll 84, a metering roll 86, and an ink supply tray or fountain 88, all of which function generally in the same manner as their counterparts on the main press 10. The rolls 80–86 span the frame plates 58 and 60 and are rotatably journalled thereby, with the exception of the plate roll 82 which is adjustably mounted and journalled in a special manner as will subsequently be described. As illustrated in FIG. 4, the metering roll 86 is provided with an adjustment device broadly denoted by the numeral 90 which permits the metering roll 86 to be rocked toward and away from the anilox roll 84 in order that the nip pressure therebetween may be varied accordingly, all of which effects the metering of ink to the anilox roll 84. Additional rolls carried by the frame plates 58 and 60 of the module 56 include a guide roll 92 located below the print station 78, a guide roll 94 located immediately adjacent the impression roll 80 on the opposite side thereof from the anilox roll 84, a guide roll 96 positioned directly above the guide roll 94 at the upper extremity of the module 56, cooperating nip rolls 98 and 100 adjacent the cantilevered outer end of the module 56, and a guide roll 102 located outwardly adjacent the nip roll 98. If desired, a stripper attachment 104 may be provided as part of the module 56, in which case a driven take-up spindle 106 is utilized to coil up the stripped off material designated by the numeral 108, such material 108 being guided during its stripping movement by the rolls 110 and 112 forming a part of the stripper 104. Depending upon the operator's preferences and other factors, the die cut station 48 shown positioned at the end of the main press 10 in FIG. 1 may be repositioned at the end of the module 56 as shown in FIG. 2, in which event the die roll 52 cooperates with the lower guide roll 102 and an additional guide roll 114 is provided adjacent the upper edge of the module 56 in the manner illustrated in FIG. 2.

Figure 7:
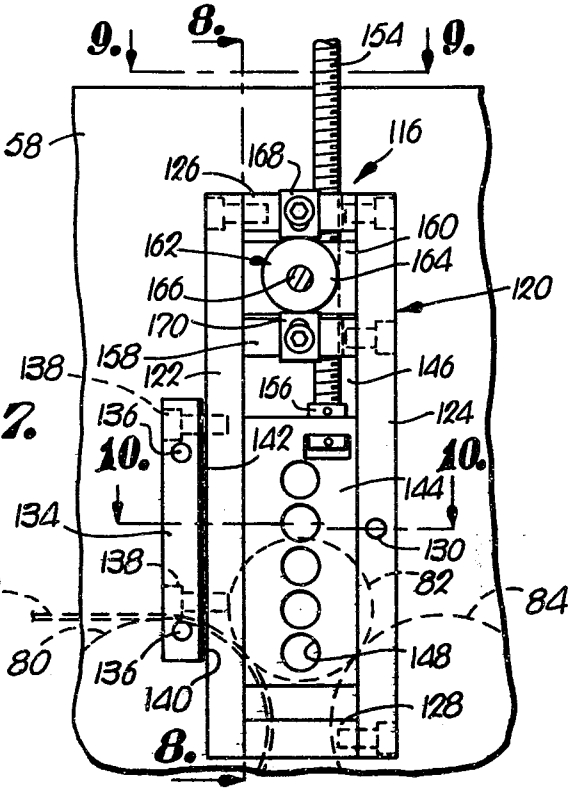
FIG. 7 is an enlarged, fragmentary elevational view of one of the two mounting assemblies for the plate roll of the module print station, which assemblies provide the special adjustment for the plate roll as hereinafter described in detail.
Figure 8:
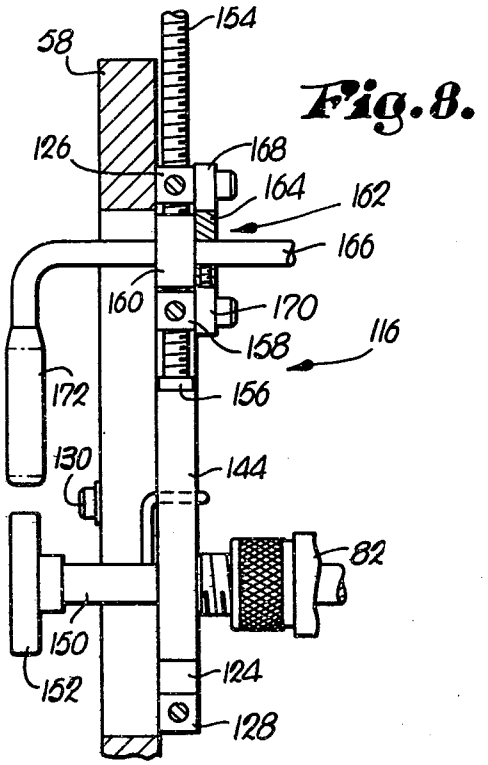
FIG. 8 is a fragmentary, vertical cross-sectional view through the mounting assembly of FIG. 7 taken substantially along line 8—8 thereof.

Returning to the print station 78, as particularly shown in FIGS. 7, 8, 9 and 10, the plate roll 82 is supported at its opposite ends by a pair of substantially identical mounting assemblies 116 and 118 supported by the frame plates 58 and 60, respectively. Each of the assemblies 116, 118 includes a track 120 of generally rectangular, open frame construction, having a pair of opposite, laterally spaced apart side rails 122 and 124 and an upper and lower crossbars 126 and 128, respectively, that rigidly interconnect the side rails 122, 124 at their opposite ends. Each track 120 is attached to its corresponding frame plate 58 or 60 by a single cap screw 130 (FIG. 10) extending through an enlarged bore 132 in the frame plate 58 or 60 and threadably received by the side rail 124 of the track 120. In this manner, when the capscrew 130 is loosened, the entire track 120 may be displaced laterally, to the extent permitted by the confines of the bore 132, toward and away from an abutment 134 rigidly fixed to the corresponding inner face of the frame plate 58 or 60 by one or more capscrews 136. As shown in FIG. 7, transversely extending capscrews 138 pass through the abutment 134 and are threaded into the proximal side rail 122 of the track 120 whereby, upon such loosening of the capscrew 130 and rotation of the capscrews 138, the entire track 120 may be drawn toward or pushed away from the abutment 134. One or more spacers 140 and 142 may be inserted into the gap formed between the side rail 122 and the abutment 134, and, as will hereinafter be made clear, it is convenient that at least one of the spacers, such as the spacer 142, have the same thickness as that of the web 20 being processed. It has even been found convenient to use a portion of the web 20 itself for the spacer 142 and then a piece of metal shim or the like for the other spacer 140.

Each of the tracks 120 guides a rectangular component 144 for reciprocal movement within an open trackway 146 defined between the side rails 122 and 124. Each of the components 144 is provided with a series of holes 148, any one of which may be selected for use in supporting the plate roll 82 and its associated parts, such as the shaft 150 and knob 152 shown in FIG. 8; thus, the plate roll 82 is carried by the reciprocal components 144 such that the plate roll 82 is mounted for movement toward and away from the impression roll 80 and the anilox roll 84 along a straight line. Such path of travel of the plate roll 82 is substantially perpendicular to an imaginary line connecting the axis of rotation of the impression roll 80 and the anilox roll 84, both of which are of substantially the same diameter whereby the plate roll 82 may be brought into simultaneous peripheral contacting engagement with the two rolls 80 and 84 when the components 144 are substantially at the lower ends of their path of travel within the tracks 120. The holes 148 are located on the center line which bisects the imaginary line between the axis of rotation of the impression roll 80 and the anilox roll 84 such that in the event that different diameter plate rolls 82 are desired, they may be supported by the appropriate one of the holes 148 without adversely affecting the simultaneous peripheral contacting engagement with the rolls 80 and 84 as above mentioned. Preferably, the impression roll 80 has a radius which is six thousandths of an inch less than the anilox roll 84 inasmuch as the typical thickness of the web 20 will be six thousandths of an inch. Thus, the simultaneous contacting engagement by the plate roll 82 is actually with the outer surface of the web 20 and the peripheral anilox roll 84. Also, in this regard, it is preferable that with the spacer 142 removed and the web 20 removed from impression roll 80, and further with the tracks 120 drawn into abutting engagement with the spacer 140 of abutment 134, the plate roll 82 will make the aforementioned simultaneous peripheral contacting engagement with the impression roll 80 and the anilox roll 84. In this way, in the event there in any tolerance buildup or the like, the tracks 120 may still be shifted toward the abutments 134 an additional amount coinciding to the thickness of the spacer 140 when the latter has been removed from each of the abutments 134.

In order to effect the reciprocal movement of the components 144 in tracks 120, each of the mounting assemblies 116 further includes an upright operating rod 154 having a connection 156 at its lower end with the corresponding component 144. The rod 154 passes slidably through the upper crossbar 126 as well as an intermediate crossbar 158 and is threaded into a block 160 slidably held between the side rails 122, 124 and limited in such up and down sliding movement by the upper crossbar 126 and the intermediate crossbar 158. Inasmuch as the rod 154 is threaded into the block 160, rotation of the rod 154 may cause the component 144 attached thereto to be raised and lowered in the track 120 relative to the block 160.

Furthermore, a quick shift of the plate roll 82 toward or away from the impression roll 80 and the anilox roll 84 may be effected through a special eccentric actuator denoted broadly by the numeral 162 which works in conjunction with the blocks 160. In this respect, the actuator 162 has a pair of cam discs 164 which are fixed to opposite ends of a crank rod 166 immediately inboard of the blocks 160 through which the crank rod 166 rotatably passes. The cam discs 164 are affixed to the crank rod 166 in eccentric relationship to the longitudinal axis of the latter and bear against upper and lower shoulders 168 and 170, respectively, which are adjustably fixed to the upper crossbar 126 and the intermediate crossbar 158, respectively. Thus, when an operating crank 172 of the rod 166 is grasped and swung in the appropriate direction, the cam discs 164, bearing against the shoulders 168 and 170, will cause the rod 66, and, thus, also the blocks 160, rods 154, components 144, and ultimately, the plate roll 82, to rise or fall to the extent of the eccentricity of the discs 164 relative to the rod 166.

Figure 3:
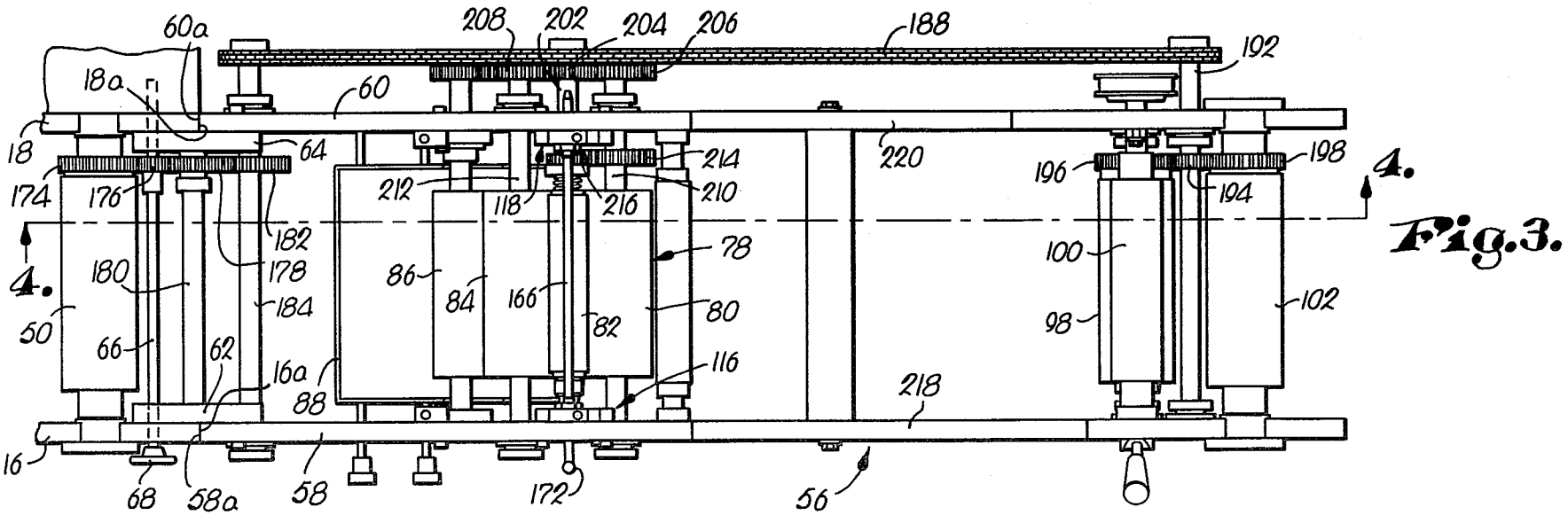
FIG. 3 is a fragmentary, top plan view of the press and the attached module with the web removed to reveal details of construction.
Figure 5:
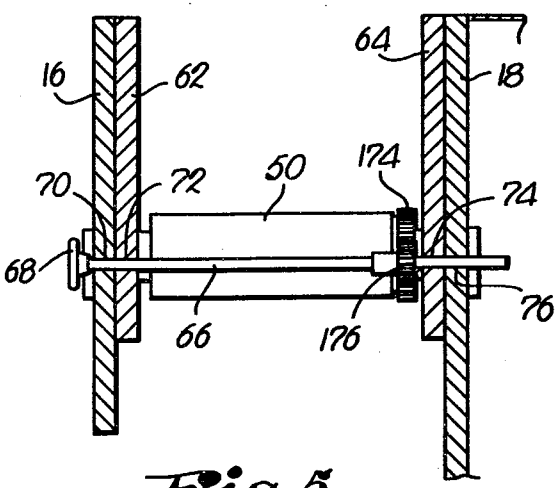
FIG. 5 is an enlarged, fragmentary, vertical, transverse cross-sectional view through the apparatus taken substantially along line 5—5 of FIG. 4.
Figure 9:
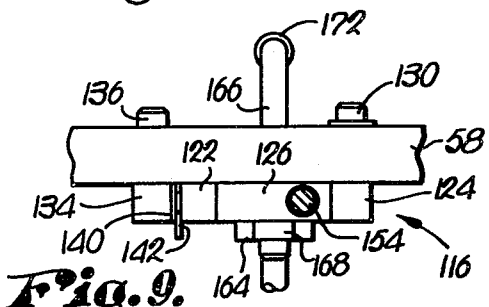
FIG. 9 is a fragmentary, horizontal cross-sectional view of the assembly taken substantially along line 9—9 of FIG. 7; and, FIG. 10 is a fragmentary, generally horizontal cross-sectional view through the mounting assembly taken substantially along line 10—10 of FIG. 7.
Figure 10:
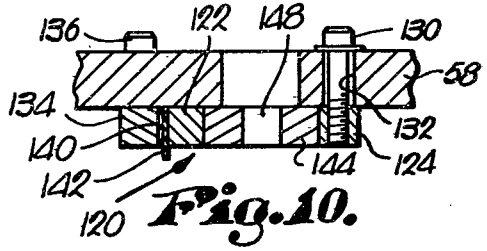

The various rolls of the module 56 are driven by power from the main press 10 through a series of gear trains and chain and sprocket assemblies. In this regard, as illustrated in FIGS. 3, 4, and 5, the roll 50 of the main press 10 has a gear 174 at one end thereof which drivingly meshes with a small gear 176 journalled on the cross pin 66. The small idler gear 176 in turn meshes with another idler gear 178 journalled on a cross shaft 180 that spans the two guide plates 62 and 64. The idler gear 178 in turn meshes with a gear 182 which is fixed to a shaft 184 journalled by the frame plates 58, 60 and projecting outwardly beyond the frame plate 60 where it carries a chain sprocket 186 for rotation therewith. The sprocket 186 is entrained by a relatively long, endless chain 188 running substantially longitudinally of the module 56 along the frame plate 60. At its opposite end, the chain 188 is looped around and entrains a sprocket 190 which is fixed to a shaft 192 journalled by the frame plates 58 and 60 adjacent the nip rollers 98 and 100.

The shaft 192 has a gear 194 fixed thereto for rotation therewith and such gear 194 is drivingly meshed with gears 196 and 198 affixed to the rolls 98 and 102, respectively, for driving the same in opposite directions. The roll 100 may simply be used as an idler roll, in which event it would not be positively driven by gears or chains, or, if desired, it may be coupled in a suitable manner with a source of driving power so as to provide a positive drive thereto beyond that which would normally occur when it is simply pressure engaged with moving web 20 and the lower roll 98 as illustrated in FIG. 2. Likewise, the roll 52 as shown in FIG. 2 may or may not be driven or even provided as aforementioned.

Figure 6:
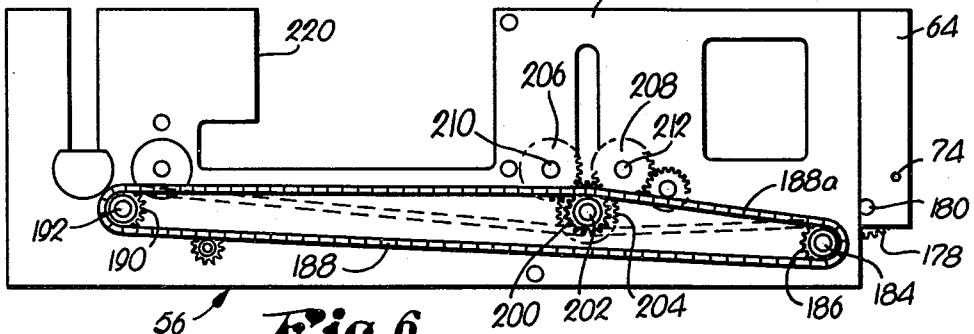
FIG. 6 is an elevational view of one side of the module illustrating a portion of the drive mechanism therefor, and, in particular, the manner in which the direction of drive may be reversed.

As illustrated particularly in FIG. 6, the chain 188 which extends between and entrains the sprockets 186 and 190 also operably engages a sprocket 200 fixed to a shaft 202 that spans the frame plates 58 and 60 generally below the print station 78. As shown most clearly in FIG. 6, the axis of rotation of the shaft 202 is at least generally intersected by an imaginary line extending between the peripheries of the two sprockets 186 and 190 so as to facilitate removal of the upper stretch 188*a* of chain 188 from one side of the sprocket 200 and replacement upon the opposite side of the sprocket 200 as illustrated in phantom lines, thereby reversing the direction of drive of the sprocket 200 and the shaft 202.

The shaft 202 also fixedly carries a gear 204 on the outboard side of the frame plate 60 for rotation with the shaft 202 in either of its directions of rotation as determined by the placement of the stretch 188*a* and chain 188 is above described. The gear 204 in turn simultaneously meshes with a pair of gears 206 and 208 that are fixed to shafts 210 and 212, respectively. The shafts 210 and 212 in turn form portions of and define the axis of rotation of the rolls 80 and 84, respectively. Driving power is supplied to the plate roll 82 via a gear 214 (FIG. 3) fixed to the shaft 210 just inboard of the frame plate 60 and by a gear 216 (FIG. 3) forming a part of the plate roll 82 and disposed in driving engagement with the gear 214. The eccentric actuator 162 is operable to throw the gear 216 into and out of engagement with the gear 214.

As shown in several of the figures, the frame plates 58 and 60 of the module 56 are provided with large cutouts or notches 218 and 220, respectively, formed into the upper edges thereof. Such notches 218 and 220 are adapted to receive an ultraviolet curing unit broadly denoted by the numeral 222 and shown in FIG. 1 positioned in place within the notches 218, 220. As illustrated, the web 20 may be passed through the curing unit 222 for the purpose of curing a special protective finish coating on the web 20 which may have been added upstream from the unit 222.

OPERATION

Operation of the press 10 and the attachment module 56 should be readily apparent from the foregoing description. Suffice it to point out, therefore, that the module 56 is quickly and easily attachable to the main press 10 for support thereby in a cantilevered arrangement using the guide plates 62, 64 and the tight abutting engagements between the end edges 16*a*, 58*a* and 18*a*, 60*a* of the main press 10 and the module 56. As will be apparent by viewing FIG. 3, for example, the gear 174 is carried by the main press 10, while the gears 176, 178 and 182 are all carried by the module 56. Thus, in order to establish driving power for the components of the module 56, it is but necessary during insertion of the cross pin 66 to also slip on the small gear 176 and to insert the same into meshing relationship between the gears 174 and 178 as full insertion of the cross pin 66 is completed. Thereupon, it only becomes necessary to determine whether front side or backside printing is desired for the web 20 by the module 56. In this regard, if front side printing is desired, such as to simply apply another color to the three-color product already produced by the main press 10, the stretch 188*a* of the drive chain 188 is positioned as illustrated in FIG. 6 on the upper side of the sprocket 200. On the other hand, if backside printing is desired, the stretch 188*a* is simply applied instead to the bottom side of the sprocket. Removal and reengagement of the stretch 188*a* with respect to the opposite sides of the sprocket 200 is quite quickly and easily carried out by virtue of the fact that the shaft 200 lies substantially on an imaginary line intersecting the peripheries of the sprockets 186 and 190 as above mentioned. Consequently, no greater stress and tension is developed in the stretch 188*a* when it is applied to one side of the sprocket 200 than when it is applied to the other side thereof, nor is significantly greater stress developed in order to remove the stretch 188*a* from the sprocket 200 and move it to the opposite side thereof.

Figure 2:
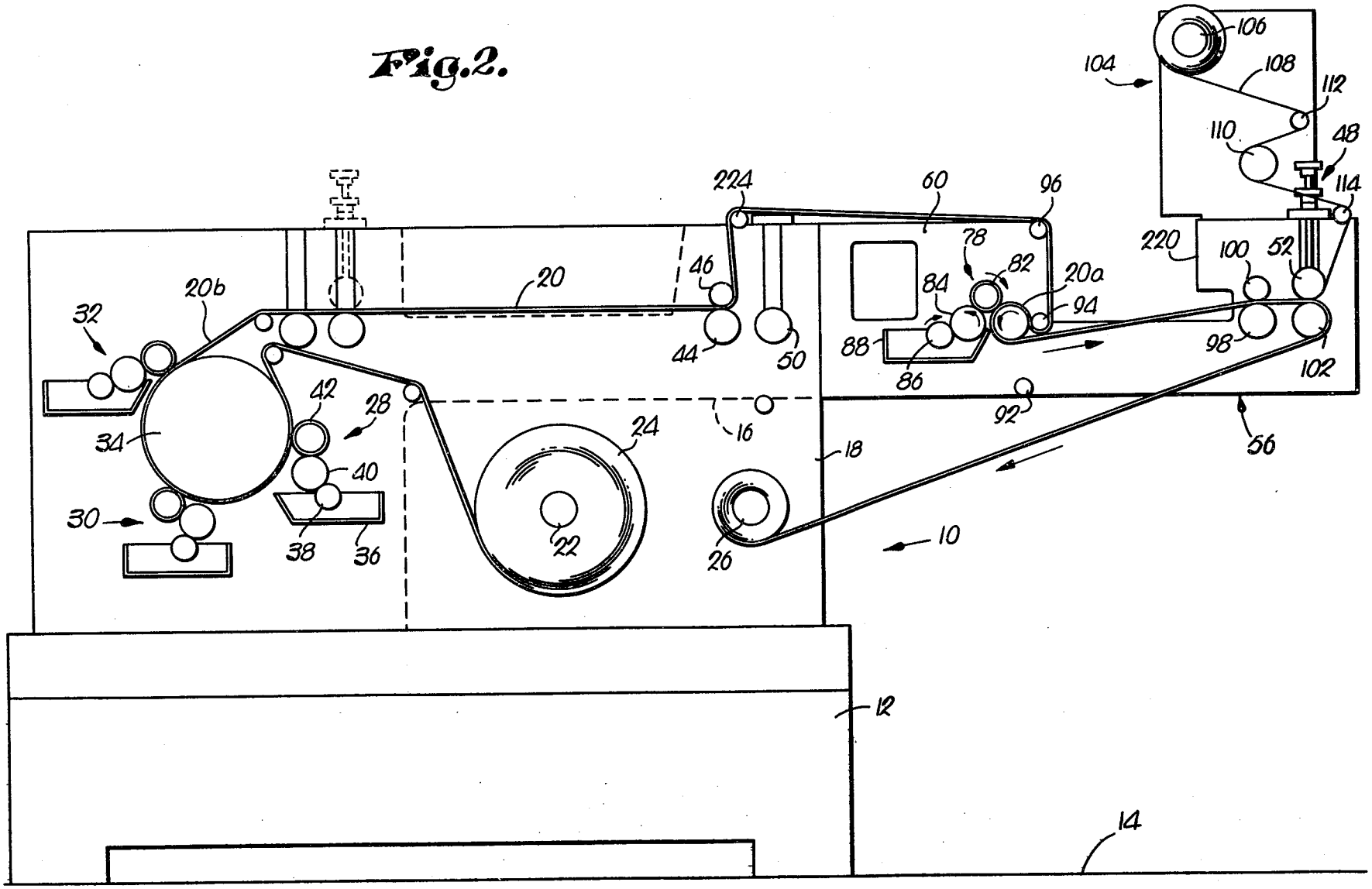
FIG. 2 is a schematic, side elevational view of the press and module as in FIG. 1, except that the apparatus is arranged for backside printing of the web by the module following front side printing thereof by the main press.

Assuming that front side printing by the module print station 78 is desired, the web 20 is trained around its various rolls in the manner illustrated in FIG. 1, in which situation the impression roll 80 is rotating in a clockwise direction as viewed in FIG. 1, while the web 20 moves rightwardly. On the other hand, in the event that backside printing is desired, the web 20, after leaving the rolls 44 and 46 of the main press 10, is then looped up and over an idler roll 224 at the upper extremity of the main press 10, before the web 20 is then extended over and around the idler roll 96 of module 56, then down and under the idler roll 94 before wrapping in a counterclockwise direction around the compression roll 80. From that point on, the web 20 is trained in the usual way around the remaining rolls.

With the stretch 188*a* of chain 188 now placed on the underside of the sprocket 200 for backside printing, the compression roll 80 rotates in a counterclockwise direction viewing FIG. 2, and, as will be noted, the backside 20*a* of the web 20 is presented to the plate roll 82 instead of the front side 20*b* thereof which was presented to the plate rolls 42 of the main press print stations 28, 30, and 32. Note that such presentation of the backside 20*a* to plate roll 82 has taken place without the use of any turnbars or the like which require that the web actually be twisted a full 180 degrees in order to reverse the surface that is presented for printing.

It is also significant to note that the direction of drive of the plate roll 82, the anilox 84, and the metering roll 86 of print station 78 is reversed along with the direction of drive of the compression roll 80 when backside printing is desired. Notwithstanding that fact, ink from the tray 88 is applied to the anilox roll 84 and properly metered by the metering roll 86 without causing untoward ink splattering because of the relationship between the metering roll 86, the anilox roll 84, and the plate roll 82. In this respect, the centers of the three rolls just mentioned are preferably disposed substantially along a common line inclined upwardly and generally toward the impression roll 80. Thus, although the metering roll 86 rotates in a counterclockwise direction for front side web printing as in FIG. 1, and, thus, picks up the ink and delivers it to the bottom of the anilox roll 84 before squeezably metering the amount that remains on the anilox roll 84, it has been found that rotation of the metering roll 86 in the opposite, clockwise direction during backside printing as in FIG. 2 has no deleterious effect upon the inking action. A shallow pool of ink simply forms above the nip between the metering roll 86 and the anilox roll 84 during backside printing, any excess simply flowing back over the top of the metering roll 86 and into the tray 88. The squeezing metering action of the metering roll 86 still has the effect of allowing only the appropriate amount of ink to remain on the anilox roll 84 as it rotates on around and up to the plate roll 82 to apply that ink to the raised surface thereof for printing. It should also be noted in this regard that because the line of centers of rolls 82, 84, and 86 is substantially at 45 degrees, the ink from metering roll 86 travels substantially no further around the top-side of the metering roll during backside printing than it does along the bottom side of the metering roll during front side printing. This is important considering the highly volatile nature of many liquid inks used in flexographic printing. Any undue delay in passing the ink from the metering roll 86 to the anilox roll 84 might result in drying of the ink.

As earlier mentioned, the ultraviolet curing unit 222 may be added as an option if such is desired. Likewise, the stripping assembly 104 may be attached to the module 56 if desired. In any event, should the increased flexibility offered by the module 56 no longer be desired, it is but a simple matter to detach the drives and dismount the module 56 from the main press 10 in a mere reversal of the steps described above.

We claim:

1. For use in combination with a flexographic web printing press having a pair of upstanding frame plates provided with flat end edges, a series of print stations including parallel driven rolls spanning said frame plates and journalled thereby, and means for driving a web through said stations, in timed relation to rotation of said rolls, an add-on, flexographic module comprising:

a chassis including a pair of parallel, laterally spaced apart side plates;

a print station carried by said chassis and including a plurality of parallel rolls spanning said side plates and journalled thereby;

web guide rolls on said chassis between said side plates in parallel relationship with the rolls of said print station of the module in disposition to receive, and return to, a web from said driving means of the press when the module is attached thereto;

means for detachably suspending said module from said frame plates of the press in such a manner that said rolls of the module are maintained in parallel relationship with said rolls of the press; and mechanism for releasably, drivingly connecting rolls of the module in timed relationship with rolls of the press when the module is attached to the press, said side plates having flat end edges disposed for abutment against said end edges of said frame plates and being provided with a pair of opposed guide plates projecting outwardly beyond said end edges of the side plates, said guide plates being spaced apart by such a distance less than that between the side plates as to permit the guide plates to slip between the frame plates of the press and into surface-to-surface engagement with the frame plates when the module is attached to the press, said suspending means including structure for releasably holding said end edges of the module side plates in abutting relationship with the end edges of the frame plates.

2. A flexographic module as claimed in claim 1, wherein said mechanism includes means for reversing the direction of drive of rolls associated with said print station of the module while the direction of drive of rolls associated with print stations of the press remains unchanged, said web guide rolls of the module being so positioned as to permit the web to be trained therearound in a manner to present the backside of the web to the module print station for backside printing thereof after front side printing by the press.

3. For use in combination with a flexographic web printing press having a pair of upstanding frame plates, a series of print stations including parallel, driven rolls spanning said frame plates and journalled thereby, and means for driving a web through said stations in timed relation to rotation of said rolls, an add-on, flexographic module comprising:

a chassis including a pair of parallel, laterally spaced apart side plates;

a print station carried by said chassis and including a plurality of parallel rolls spanning said side plates and journalled thereby;

web guide rolls on said chassis between said side plates in parallel relationship with the rolls of said print station of the module in disposition to receive, and return to, a web from said driving means of the press when the module is attached thereto;

means for detachably suspending said module from said frame plates of the press in such a manner that said rolls of the module are maintained in parallel relationship with said rolls of the press; and mechanism for releasably, drivingly connecting rolls of the module in timed relationship with rolls of the press when the module is attached to the press, said mechanism including means for reversing the direction of drive of rolls associated with said print station of the module while the direction of drive of rolls associated with print stations of the press remains unchanged, said web guide rolls of the module being so positioned as to permit the web to be trained therearound in a manner to present the backside of the web to the module print station for backside printing thereof after front side printing by the press, said mechanism including a gear train associated with the rolls of said module print station, one gear of said train having a sprocket associated therewith, said mechanism further including a drive chain having a stretch driven in a certain predetermined dirction and adapted to be operably engaged with either selected one of the opposite peripheral sides of said sprocket whereby to provide said reversing means.

4. A flexographic module as claimed in claim 3, wherein said drive chain is provided with a pair of spaced apart sprockets about which the chain is looped, said sprocket associated with said one gear of the train having its axis of rotation disposed substantially on an imaginary line extending between and intersecting the peripheries of said pair of sprockets whereby to facilitate changing said stretch of the chain from one side to the opposite side of the sprocket associated with said one gear.

5. A flexographic module as claimed in claim 1, wherein said side plates are provided with a pair of transversely aligned notches; and an ultraviolet curing unit received within said notches and spanning said side plates in disposition to receive and treat the web as it passes through the module.

6. A flexographic module as claimed in claim 1, wherein said print station of the module includes an impression roll about which the web is entrained, a plate roll for engaging the web and transferring a predetermined image thereto, and an anilox roll for engaging the plate roll and delivering the ink thereto, said plate roll being provided with an assembly supporting the same for reciprocal movement into and out of simultaneous peripheral contacting engagement with said impression roll and said anilox roll, said assembly including means for adjustably laterally displacing the path of reciprocal movement of the plate roll to accommodate different web thicknesses.

7. A flexographic module as claimed in claim 6, wherein said assembly includes a track releasably secured to a side plate against lateral shifting thereof and a plate-roll-supporting component movable in said track along said path of reciprocal movement, said displacing means including an abutment on the side plate against which said track may be located after temporarily releasing said track for said lateral shifting, and spacer means insertable between said track and the abutment for maintaining the same spaced apart when the track is secured for operation.

8. In a flexographic printer having a pair of laterally spaced apart, upright support plates and a print station supported between said plates, said print station including an impression roll about which a moving web may be entrained, a plate roll for engaging the web and transferring a predetermined image thereto, and an anilox roll for engaging the plate roll and delivering ink thereto from a source of supply, the improvement comprising an assembly adjustably mounting said plate roll on said support plates, said assembly including:

a track on each of said support plates defining a rectilinear path of travel;

a pair of components at opposite ends of said plate roll, journalling the same for rotation and movable along said tracks, said tracks being so positioned as to permit said plate roll to simultaneously peripherally engage said impression roll and said anilox roll when the components are adjacent one end of said paths of travel;

means for effecting said movement of the components and for releasably holding the same at selected positions along the tracks; and means adjustably attaching said tracks to the plates for selective adjusting displacement thereof in a direction transverse to said paths of travel to compensate for variations in thickness of different webs passed through the printer, said tracks each being provided with an abutment fixed to the corresponding support plate and against which the track may be positioned, said tracks being shiftable toward and away from said abutments during said transverse adjusting displacement thereof, said abutments having spacer means positionable between the same and the tracks.

9. In combination with a central impression flexographic web printing press having a web to be printed, a central impression roll, a series of primary print stations positioned about said central impression roll and including parallel driven rolls disposed for cooperation with the central impression roll in performing a series of immediately successive printing operations on a front side of the web looped about the central impression roll and driven through said stations, means for paying out the web to said central impression roll and said print stations, and means for taking up the web after said front side has been printed by said primary print stations, a backside printing attachment for the web comprising:

a chassis detachably secured to the press and including a pair of parallel, laterally spaced apart side plates;

a backside print station carried by said chassis and including a plurality of parallel rolls spanning said side plates and journalled thereby;

web guide rolls on said chassis between said side plates in parallel relationship with the rolls of said backside print station in disposition to receive the web from the press and return the same to said web take up means of the press; and mechanism releasably, drivingly connecting the rolls of the chassis in timed relationship with rolls of the press;

said web being so trained around the guide rolls and printing rolls associated with said backside printing station, and the rolls of the backside printing station being driven in such a direction relative to the central impression roll of the press, as to cause the backside printing station to perform a printing operation on the backside of the web as it passes therethrough before returning to the web take up means of the press.

* * * * *